US007152383B1

(12) United States Patent
Wilkinson, Jr. et al.

(10) Patent No.: US 7,152,383 B1
(45) Date of Patent: Dec. 26, 2006

(54) JOINING OF FOAM CORE PANELS

(75) Inventors: E. Lee Wilkinson, Jr., Cincinnati, OH (US); Edgar L. Wilkinson, Cincinnati, OH (US)

(73) Assignee: EPS Specialties Ltd., Inc., Cincinnati, OH (US)

( * ) Notice: Subject to any disclaimer, the term of this patent is extended or adjusted under 35 U.S.C. 154(b) by 21 days.

(21) Appl. No.: 10/731,201

(22) Filed: Dec. 10, 2003

Related U.S. Application Data

(63) Continuation-in-part of application No. 10/409,719, filed on Apr. 10, 2003, now abandoned.

(51) Int. Cl.
*E04B 2/00* (2006.01)

(52) U.S. Cl. ..... 52/581; 52/588.1; 52/582.1; 52/586.1; 52/586.2; 52/585.1

(58) Field of Classification Search ..... 52/506.01, 52/506.04, 506.05, 506.07, 506.08, 506.09, 52/506.1, 507–513, 578, 582.1, 582.2, 583.1, 52/584.1, 587.1, 586.1, 586.2, 585.1, 782.1, 52/783.1, 796.1, 792.1, 794.1
See application file for complete search history.

(56) References Cited

U.S. PATENT DOCUMENTS 2,863,185 A * 12/1958 Reidi ..... 403/297
2,882,564 A * 4/1959 Couse et al. ..... 52/465
3,159,514 A * 12/1964 McKnight, Jr. et al. ..... 156/79
3,310,917 A * 3/1967 Simon ..... 52/91.1
3,512,819 A * 5/1970 Gillingwater et al. ..... 52/461
3,557,507 A * 1/1971 Wilder ..... 52/404.1
3,563,582 A * 2/1971 Shroyer et al. ..... 52/309.13
3,640,039 A * 2/1972 McKee et al. ..... 52/281
3,641,730 A * 2/1972 Meckstroth ..... 52/586.2
3,831,339 A * 8/1974 Piralli ..... 52/584.1
3,979,869 A * 9/1976 Beehler ..... 52/514
4,068,434 A * 1/1978 Day et al. ..... 52/220.1
4,128,983 A * 12/1978 Matsubara ..... 52/731.5
4,147,004 A * 4/1979 Day et al. ..... 52/309.9
4,774,794 A * 10/1988 Grieb ..... 52/309.7
4,989,386 A * 2/1991 Collis ..... 52/584.1
5,058,333 A * 10/1991 Schwartz ..... 52/73
5,138,812 A * 8/1992 Palmersten ..... 52/588.1
5,260,325 A * 11/1993 Markwalder et al. ..... 514/381
5,279,089 A * 1/1994 Gulur ..... 52/309.11
5,339,576 A * 8/1994 Fussler ..... 52/71
5,343,665 A * 9/1994 Palmersten ..... 52/588.1
5,471,804 A * 12/1995 Winter, IV ..... 52/220.1
5,509,242 A * 4/1996 Rechsteiner et al. ..... 52/270

(Continued)

*Primary Examiner*—Jeanette E. Chapman
(74) *Attorney, Agent, or Firm*—Edmund S. Lee, III

(57) ABSTRACT

A blind connection for joining foam core panels which comprise a central sheet of foamed resinous material having top and bottom rails and veneers bonded to opposite sides of the central sheet and the rails. The rails having abutting side edge faces with matching slots formed along the length of the side edges. Te slots have undercut retaining surfaces which are engaged by retaining surfaces formed on a joining member which is inserted into these slots in joining the panels in assembled relation. The use of modified joining members in connecting foam core panels that are in angled relation to each other is also described. Wear resistant retaining surfaces may be provided for slots in the foam core by solid polymer liners. Additionally a method customizing panels on an installation job site is provided through the use of portable electrically powered saw to cut a panel to a desired width and a portable electrically powered router to form and undercut slot for receiving a joining member.

34 Claims, 7 Drawing Sheets

U.S. PATENT DOCUMENTS 5,687,956 A * 11/1997 Vesper ..... 256/31
5,934,039 A * 8/1999 Guy ..... 52/747.12
6,014,849 A * 1/2000 Yonemura ..... 52/586.1
6,108,994 A * 8/2000 Bodine ..... 52/506.07
6,230,463 B1 * 5/2001 Bodine ..... 52/506.07
6,318,042 B1 * 11/2001 Bloom et al. ..... 52/506.07
6,481,172 B1 * 11/2002 Porter ..... 52/506.01

* cited by examiner

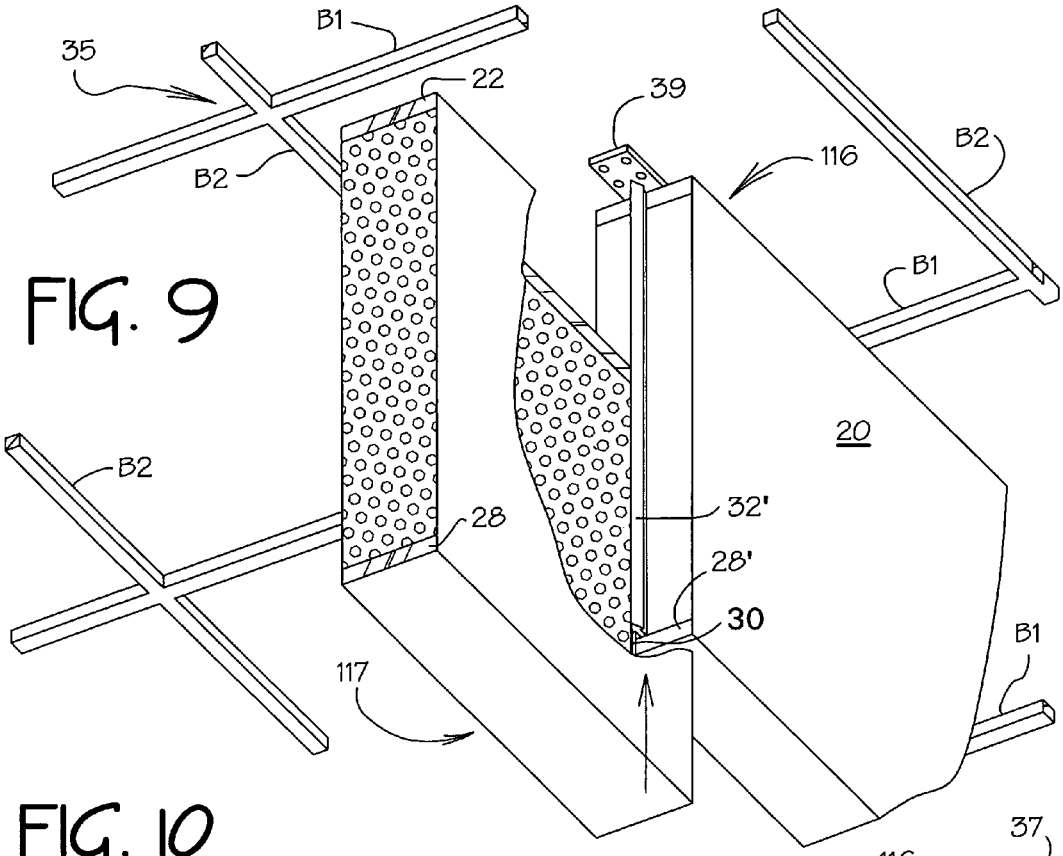
FIG. 9
FIG. 10
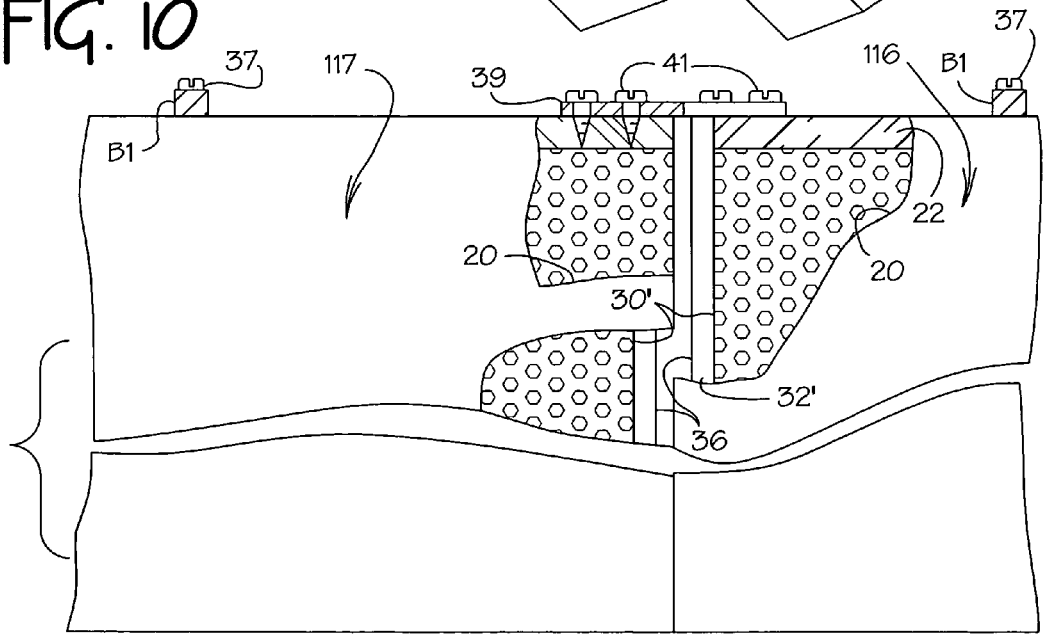

JOINING OF FOAM CORE PANELS

The present application is a continuation in part of our application Ser. No. 10/409,719 filed Apr. 10, 2003 now abandoned.

The present invention relates to improvements in joining of foam core panels in side-by-side relation, and more particularly to providing improved, blind connectors for such purpose.

There are many applications where foam core panels are employed in the fabrication of structures, which can serve various purposes. The present invention will find utility in a wide variety of these applications, and is particularly motivated by a desire to reduce the cost of decorative valances, also referenced as soffits or bulkheads, that project downwardly from the overhead portions of an interior room, or other enclosed space. It is desired that these valances have substantial thickness for the decorative effect that is being sought. At the same time it is necessary that the weight of the valances being minimized to the greatest extent possible in order to minimized the loadings on the structure of the building in which the room is located, and, at least as importantly, to facilitate their installation without resort to hoists or other mechanical assists in their installation.

Such ends are facilitated by the use of foam core panels, which have veneers, respectively, on opposite sides of the core. These veneers can provide structural rigidity to the panels and also inhibit deformation of the relatively soft foam core material. The veneer, or laminated surface can then provide a decorative surface of virtually any hue or decorative effect. Laminated, foam core panels are well known in the art and find a wide variety of applications beyond their use in forming valances.

When a valance is to be provided for a given location, it is first designed and its specifications established for length, height, and the number of sections that are to comprise the installed valance. Typically, a valance may be outwardly spaced from and run for several feet along one wall of a room to a corner and then be spaced from and run for several feet along another wall. Various factors influence the number of individual panels that are to be assembled together in forming the desired valance. The usual practice in the industry is for the vendor of the valance to fabricate the panels required for a given valance. This set of panels is then installed at some remote location.

It is also the usual practice in forming panels to be used for this type of valance to provide wooden rails along the top, bottom and side edges of the foam core, the veneer, or laminate, on the front and rear faces of the panel then overlies and is coextensive with these wooden rails, as well as the foam core itself. The wooden rail on the top side of the panel facilitates attachment of mounting means for suspending the panel (and the valance) from the overhead structure of the room. The provision of wooden rails to define the vertical side edges of the panel facilitates mounting of the hardware that is conventionally employed in providing a blind connection of the panels to join them in abutting edge-to-edge relation.

While it is possible to fabricate panels having a length of 8 feet or even up to sixteen feet. Such longer panels cannot be simply cut to a desired length for a given installation because of the requirement for wood rails along the side edges of the panels in order to provide a blind connection. Thus each panel that is to be used in a valance, must be individually laid up and bonded to form a usable panel. The disadvantages of the requirement for wooden rails along the side edges of such panels is even more pronounced where it is founded that the length of a panel needs to be shortened during the process of installation at a remote site. It is a simple enough matter to cut off a portion of a panel to shorten its length, but the real problems are encountered in providing a wooden strip along the freshly sawn edge. It is necessary to rout out the foam core, and top wooden rail in order to provide a new wooden rail. Great care is required in order to avoid marring the decorative surfaces of the panel. The alternative to remaking the panel in this fashion is to use a plate that spans the adjacent panels. In fact the use of such connector plates is an alternate connecting means, which can be used to eliminate the need for rails along the side edges of connected panels. However connector plates do not provide a truly blind joining means, nor do they reliably maintain the desired connecting relation, as will be more fully described in connection FIGS. 2 and 3 in the drawings.

Accordingly, a primary object of the invention is to provide an improved connection for joining foam core panels in side-by-side relation.

Another object of the invention is to provide an improved blind connection for joining foam core panels in which the panels are firmly held in abutting relation.

Still another object of the invention is to assure hightwise alignment of foam core panels that compositely form a valance that is mounted on an overhead suppoty.

A further object of the invention is to achieve the foregoing ends and also to simplify field modifications of the length of panels in order to custom fit the panels for a given installation.

Yet another object of the invention is to simplify and facilitate the joining of foam core panels of substantial height, for example panels having a height in the order of eight feet or so, particularly where there may be limited overhead clearance.

The foregoing ends may be broadly achieved by an assembly of foam core panels comprising a pair of panels in joined relation. Each of the panels has a foam core and outer veneers disposed on opposite side faces of the core and coextensive thereof. The panels have, respectively, vertical side edge faces which are in abutting relation with each other.

Means are provided for joining these panels with the vertical faces held in abutting relation. These means comprise slots, formed, respectively, lengthwise of the panel abutting faces. Each slot is undercut to form a retaining surfaces facing away from the abutting face in which it is formed. A joining member is inserted into said slots to provide the joining function. The joining member has surfaces respectively engaging the retaining surfaces of said slots, thereby maintaining the panels in joined relation with their edge faces in abutting relation.

Other features of the invention include the provision, for each panel, of a top rail and a bottom rail, through which the slots also extend, and in which the joining member is disposed, so that the forces imposed on the foam cores in holding the panels in joined relation are minimized. Additionally, a veneer overlies one rail of either the top or bottom rail of both panels so that the joining means can be concealed from either the top of, or the bottom of the joined panels. Means can be provided in the top rail of at least one joined panel for connecting the panels to an overhead support, in which case, the veneer would be applied to the lower rails of the panels.

Preferably, the slots, at the edge faces of the panels, extend inwardly at right angles thereto, and each slots slot has an undercut T-shaped cross section. The joining member has a planar, central web which is snugly received by narrow portions of the T-shaped slots, and thickened outer ends on which the retaining surfaces of the joining member are formed on planes parallel to the side edge faces of the panels.

The versatility of the invention is evidenced by an assembly of foam core panels wherein the panels are angularly disposed one relative to the other, the abutting side edges are mitered, the outer ends of the slots are aligned for receipt of a central portion of the joining member and the bottoms of the slots are enlarged. Alternatively, the outer ends of the slots may be angled and the central portion of the joining member may be correspondingly angled so as to be received by the slots.

Where the panels are to be frequently assembled and then disassembled, it is advantageous to provide a liner of solid polymer material to define retaining surfaces on the slots of in the foam core, thereby overcoming the problem of losing a tight connection between panels because of abrading of the foam core. Other aspects of the invention are found in the manner in which this liner is provided in the slots through the foam core.

Further features of the invention are found in joining the side edge of one foam core panel to the front face of a second foam core panel, intermediate its length. Further, where the foam core panels are relatively thick, it is preferred to employ two joining members in providing the connecting function, and advantageous that both have the same cross section.

Another aspect of the invention lies in the manner in which an accurate alignment of joined panels may be had in the provision of an overhead valance and the resultant valance itself. To attain this end, each panel has a vertical edge face adapted to be engaged by the edge face of the other panel, and each of the vertical edge faces has a vertical slot formed in the respective edge faces thereof. The bottoms of these slots are undercut to define retaining surfaces. These panels are to be interconnected by a joining member having a relatively thin central portion and opposed retaining surfaces at its opposite side for engagement with the undercut surfaces of said slots. In joining these panels, one of them is mounted on an overhead support. Preferably before being so mounted, a joining member is inserted in the undercut slot of that panel, with a portion the joining member projecting outwardly from the vertical edge face thereof, and a plate leveler is secured to the top of the panel to thereby capture said joining member in the slot thereof. The plate leveler is also mounted so as to project beyond the vertical edge face of said one plate. The other panel may then be positioned below the mounted panel with its vertical edge face aligned with the vertical edge face of the mounted panel. This other panel may then be displaced upwardly into engagement with the plate leveler to capture the outwardly projecting portion of the joining member in the vertical slot of the other panel. The other panel may then be secured to the overhead support, and to the plate leveler.

Still another aspect of the invention lies in an improved method of joining relatively tall panels and the structure so provided.

To such ends, each panel, of a pair of panels, may have a vertical edge face adapted to be engaged by the edge face of the other panel. Each of the vertical edge faces has a vertical slot formed in the respective edge faces thereof, and at least the lower and upper end portions of the bottoms of said slots are undercut to define retaining surfaces, In joining these panels, a joining member is inserted into the lower end portion of the slot in one of said panels. The joining member has a retaining surface engageable with the undercut surface of the portion of the slot into which it is inserted and also projects outwardly from the vertical edge face of the one panel. An alignment strip is inserted into the slot in the one panel. The alignment strip is disposed above the joining member and has a portion of uniform thickness projecting beyond the edge face of said one panel. The other of the pair of panels is positioned with its edge face in opposed, spaced relationship from the vertical edge face of the one panel, and with the lower end of the other panel above the upper end of the joining member projecting from the one panel. The other panel is then displaced toward the one panel, to bring their vertical edge faces into engagement and simultaneously introduce the alignment strip into the vertical slot of the other panel. After these edge faces are engaged, the other panel is displaced downwardly to capture the joining member in the lower end portion of the vertical slot in the other panel. The joining member has second positioning surfaces which are thereby engaged with the undercut retaining surfaces of the slot in the other panel. A second joining member is then inserted in the upper end portions of the slots of the two panels. The second joining member also has opposed retaining surfaces which are thereby engaged with the undercut portions of the slots.

Another aspect of the invention is found in a method for customizing foam core panels that are to be connected by joining members having opposed retaining surfaces that are engageable with retaining surfaces provided by undercut slots formed longitudinally of abutting edge faces of joined panels. In customizing such panels, a foam core panel may be first marked to indicate the portion of the panel that must be removed to provide a desired panel length for a given installation. Next, the portion of the panel necessary to be removed to provide a desired length is removed. In so doing a freshly cut edge face is formed on the panel. An undercut slot may then be formed longitudinally of said freshly cut edge face. Preferably a portable, electrically powered saw is employed to remove the portion of the panel necessary to provide the desired panel length. Also a portable, electrically powered router is employed to form the slot, all to the end that the customizing function may be readily carried out at an installation job site.

The above and other related objects and features of the invention will be apparent from a reading of the following description of the embodiments of the invention found in the accompanying drawings and the novelty thereof pointed out in the appended claims.

In the drawings:

FIG. 9 is a perspective view looking upwardly at an overhead support grid and illustrating a further method of joining foam core panels in forming a valance;

FIG. 10 is an elevation, with portions broken away, of the panels seen in FIG. 10 in their fully assembled relation;

Figure 1:
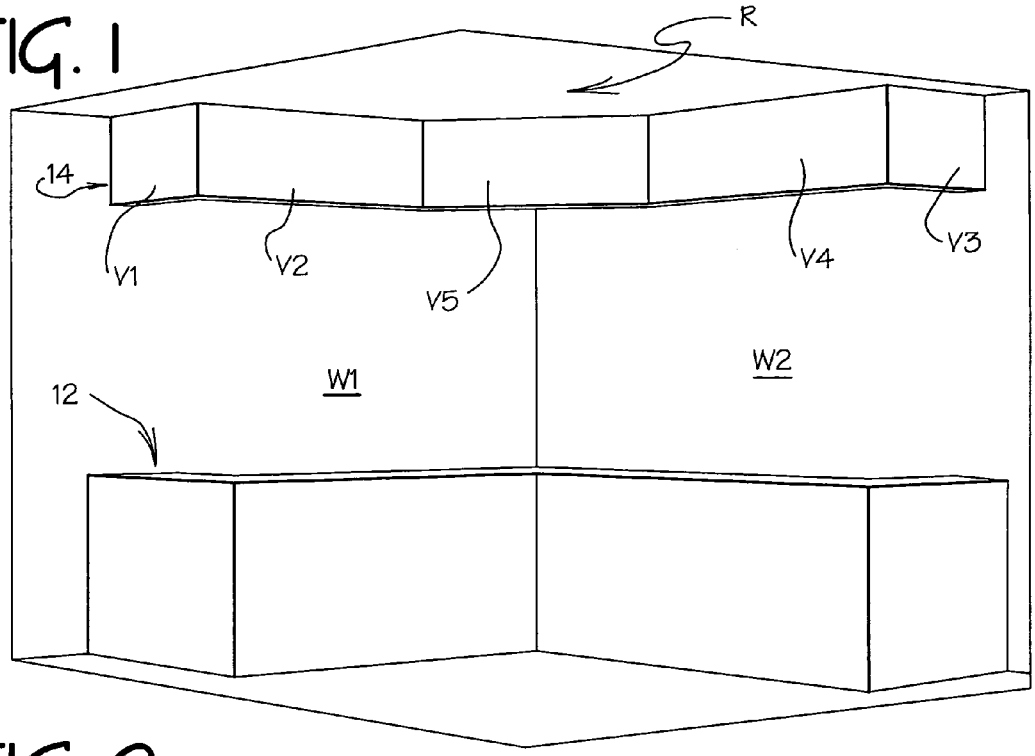
FIG. 1 is a perspective view a corner of a room in which a valance, comprised of a plurality of foam core panels has been installed.

The motivating environment for the present invention will be first described in connection with FIGS. 1–3. FIG. 1 schematically illustrates a corner portion of a room R, as might be found in a retail store. Typically there would be a counter 12, which is illustrated with an L-shaped configuration, behind which service personnel stand in dealing with customers. In order to further set this transaction area apart for the remainder of the room, a valance 14 is suspended from some overlying structure of the building. The illustrated valance has a portion V1, which juts out from one side wall W1 of the room, in overlying relation to the underlying counter 12, then has a portion V2 which overlies the portion of the counter which is spaced outwardly from the wall W1. Another portion V3 of the valance 14, juts outwardly from an adjacent wall W2 and then has a portion V4 overlying the portion of the counter 12 which is spaced outwardly from the wall W2. The valance portions V2, V4 are interconnected by an angled portion V5.

The valance portions V1–V5 are each comprised of one or more foam cored panels 16. Each panel comprises a central sheet 18 of resinous foam material. Expanded polystyrene is a preferred foam material because of its ready availablity and relatively low cost. However, any material having a comparable low specific weight and similar mechanical properties could be employed. Another advantageous property of expanded polystyrene is that it is capable of being cut and shaped through the use of common wood cutting tools into shapes and configurations that are capable of resisting deformation.

Even so, expanded polystyrene is readily deformable when subjected to concentrated loadings. For this reason the panels further comprise veneers 20 bonded to opposite faces of the central, foam core 18. The veneers not only provide a dent resistant surface to the panels 16, but also facilitate the provision of a decorative surface for such panels. The veneer its self may also be a laminate, comprising, for example, a hardboard panel and a paper surface on which advertising or informative text has been printed.

The panels further comprise wooden rails 22 extending along their top edges. The top rail 22 may provide structural means for mounting the panels in suspended fashion from appropriate overhead structure of the building. It will also be mentioned that wooden rails may also be provided to define the bottom edge portions of the panels, as a further protection against inadvertent damaging of the panels during handling and installation. The outer veneers 20 overlie and are coextensive with the foam core 18 and any wooden rails that further comprise the panel 16.

Figure 2:
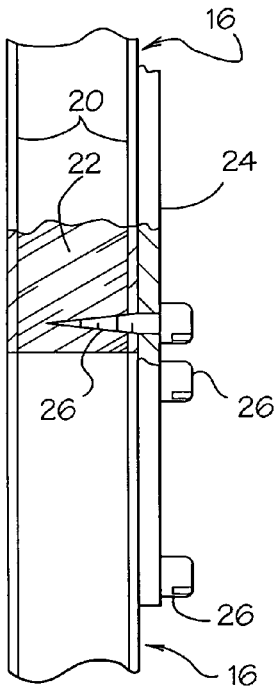
FIG. 2 (PRIOR ART)
FIG. 2 is a top view, with portions broken away and in section, of joined panels in the valance illustrated in FIG. 1, illustrating a prior art proposal for joining adjacent panels.
Figure 3:
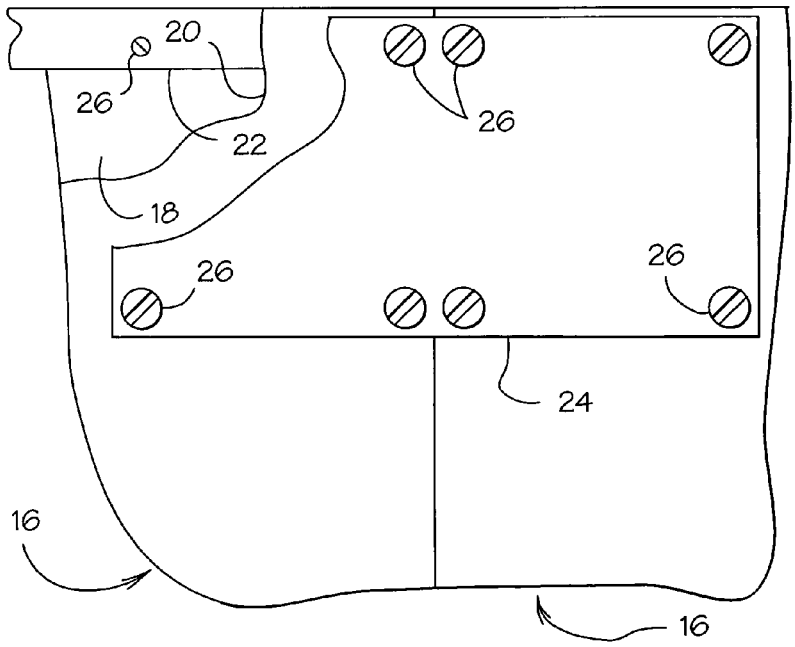
FIG. 3 (PRIOR ART)
FIG. 3 is a rear elevation, with portions broken away, of the joined panels seen in FIG. 2.

FIGS. 2 and 3 illustrate the above referenced use of connector plates 24 to join adjacent panels. The plates 24 are mounted on the rear side of the valance, so that, in most cases, they will not be visible. Screws 26 extend through the plates and then may be threaded into the top rails 22 or the veneers on the rear faces of the panels, or into both. The lower screws 26 are threaded into the underlying veneers 20.

While the use of connector plates does have the advantage of eliminating the need for wooden side rails, which are required for conventional blind connectors, there are definite shortcomings. In theory the panels should be just as tightly connected as in other methods, in providing a seam, between adjacent panels, that is virtually invisible. In practice, however, it often times happens that obviously visible gaps and or misalignments occur to the end that the desired visible affect of an uninterrupted facade is not achieved. Additionally, in many cases the rear of the valance is visible so that the crudity of the connector plate is exposed. For these reasons the use of connector plates is primarily reserved for situations where the length of a panel must be shortened during installation, where it is impractical to reinstall the blind connectors.

Figure 4:
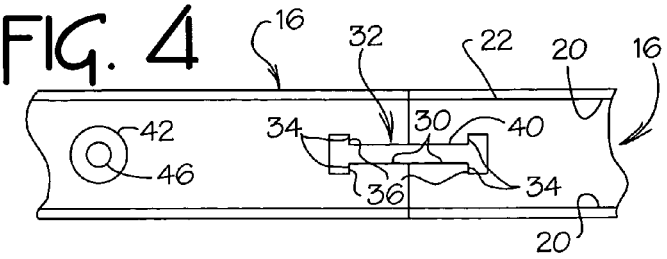
FIG. 4 is top view of foam core panels joined in accordance with the teaching of the present invention.
Figure 5:
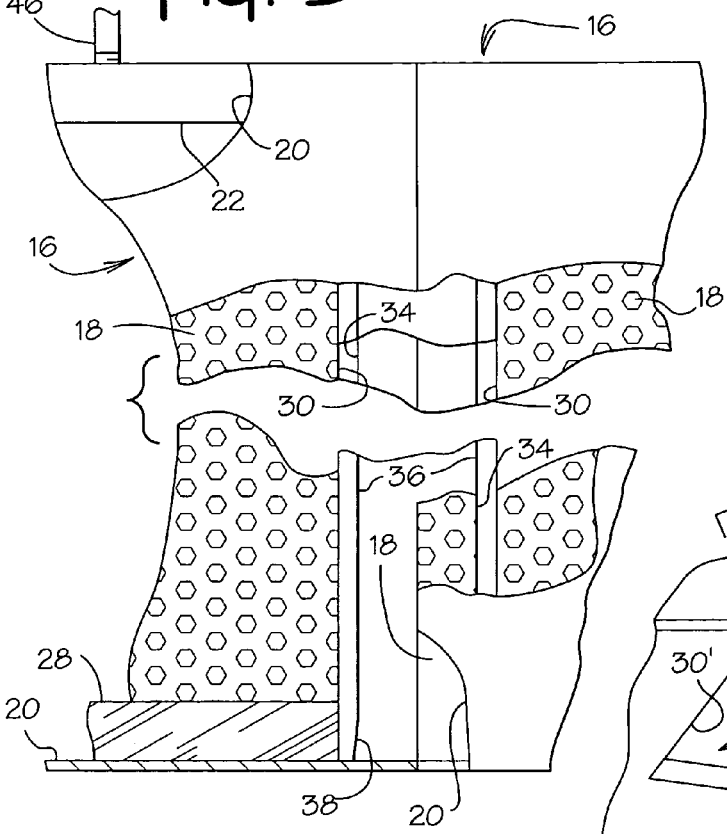
FIG. 5 is an elevation, with portions broken away and in section, of the joined panels seen in FIG. 4.

Reference is next made to FIGS. 4 and 5 for a description of the manner in which panels are joined in accordance with the present invention.

The basic configuration of the panels employed in the present invention may be the same as previously described, each panel being comprised of an expanded, polystyrene central core 18, a top, wooden rail 22 and a bottom rail 28. Veneers 20 overlie and are bonded to the core 18 and the rails 22, 28. Each of the adjacent panels 16 has a T-shaped slot 30 extending lengthwise of its abutting side edge. The panels are held in assembled relation by a joining member 32, which is inserted into the slots 30 of adjacent panels.

The joining member 32 has a cross section which approximates the cross section of the matching slots 30 in the abutting panels 16. More importantly, the slots have undercut, retaining surfaces 34 that face away from the edge face into which the slot 30 is cut. The joining member 32 has retaining surfaces 36 which face toward each other and respectively engage the slot retaining surfaces 34 when the member is inserted into these slots. The distance between the surfaces 36 on the member 32 should at least closely approximate the distance between the surfaces 34, when the edge faces of the panels are in abutting relation.

Preferably, the distance between the surfaces 36 is somewhat less than the distance between the surfaces 34. Thus, when the member 32 is inserted into its joining position, the foam material will be slightly compressed, to the end that the panels 16 will be more firmly held in assembled relation, with an assurance that there will be no gap between the panels. To the end of facilitating insertion of the member one or both of the surfaces 34 may be beveled outwardly, as indicated at 38. These beveled surfaces then facilitate insertion of the member 32 into the slots 30, and provide a camming action which assists in tightly drawing the panels toward each other as the member 32 is full inserted to the bottom of the panels 16.

It is also preferred that thickness of the central, web portion 40 of the joining member at least approximate the width of the narrow portions of the slots 30, in order that the outer surfaces of the panels will be maintained, respectively, in common planes. The dimensions of the remaining portions of the member are not critical, so long as there is no interference of material that would impair the ability to readily insert the joining member 32 into the slots 30. Usually, some nominal amount of clearance would be provided between adjacent surfaces which do not have a positioning/joining function.

It will be seen that the slots 30 preferably extend through both the top and bottom wooden rails 22, 28 and the joining member 32 extends from the top wooden rail 22 to and into the bottom rail 28. The fact that the joining member 32 engages retaining surfaces 34 formed on the relatively incompressible wooden rails, minimizes the amount to which the foam core will be compressed compression. This is to point out that, where there are wooden rails at the top and bottom of each panel, the compressive forces, exerted by the joining member are carried primarily by these rails. These compressive forces may also be carried by the abutting laminates 20, all to the end that foam core can be essentially isolated from the stress loading created in tightly joining adjacent panels.

The last described factor is of particular relevance in other applications of the present invention where panels are joined in forming structures that are used in one location and then dismantled for storage and/or transportation, so that the structure may later be reassembled for subsequent use by simply using the joining members to reconnect the panels.

As previously indicated, the top wooden rail 22 facilitates mounting of the assembled panels, which comprise the valance. To this end a metal insert 42 may be provided in the top rail 22 for threadingly receiving a support rod 46 that depends from some overlying structure of the building.

Another feature to be noted is that a veneer strip 44 is provided on the bottom surface of each bottom rail 28. The veneer strips 44 cover underlie and hide from view the lower ends of the slots 30 and the joining members 32—all to the end that a truly blind connection is provided.

Figure 7:
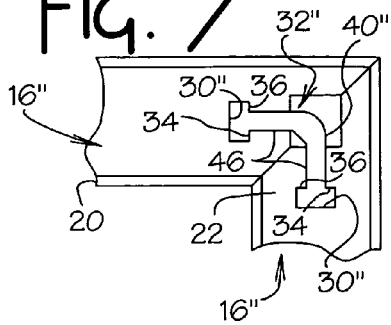
FIG. 7 is a top view of a pair of foam core panels joined in accordance with other teachings of the present invention.
Figure 6:
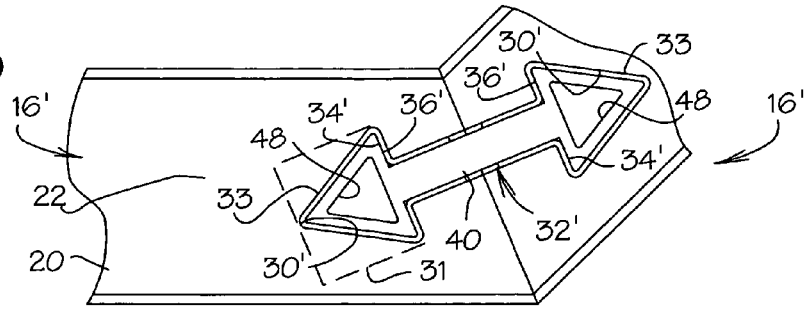
FIG. 6 is a top view of a pair of joined, foam core panels, further illustrating the advantages of the present invention.

FIGS. 6 and 7 illustrate further advantages of the present invention in providing blind connectors for panels that are relatively angled, as opposed to the aligned panels that have previously been discussed.

FIG. 6 illustrates panels 16' connected at 45° to each other, as would be the relation of valance portions V4, V5 in FIG. 1. The panels 16' may comprise, as before top and bottom rails, a foam core and front and rear veneers, albeit only the top rails 22 and veneers 20 are seen in this top view of the panels. The abutting side edges of the panels are mitered on an angle of 22.5°, so as to form a relative angle of 45° between the panels. The slots 30' are disposed normal to the edge faces of the panels and extend downwardly to and through the bottom rails which are not shown.

Each slot 30' is formed with an narrow outer portion which extends inwardly, at right angles to the vertical, side edge of the panel 16' and then has an undercut portion which defines the retaining surfaces of the panel slot. In the Embodiment of FIG. 6, the cross section of the inner end portion is tapered. For a given width of retaining surface (34') this tapered configuration minimizes the amount of material that is removed in making provision for receipt of a correspondingly tapered, outer portion of a joining member 32'. The significance of this taper is further illustrated by the dotted line outline 31 of a square, undercut configuration (as in FIG. 4), which demonstrates the weakening of the panel material (foam core and top or bottom rails). The advantages of the tapered cross section is even more apparent when joining mitered panels at right angles to each other.

FIG. 6 also illustrate a further feature of the invention which finds advantageous use in applications of the invention where it is contemplated that the panels will be repeatedly assembled and then disassembled and then assembled again, either in another location or in order to assemble the panels in different fashion in the same location. As previously indicated, foamed polystyrene, and similar materials suitable for purposes of the present invention, are easily deformed and abraded. For this reason, repeated insertions and withdrawals of a joining member can degrade the ability of obtaining a tight connection between joined panels. This is particularly the case where it is desired to eliminate one, or both of the top and bottom, wood rails.

In order to overcome the this shortcoming of the foamed material, the slots 30' are provided with solid, plastic liners 33. There are many resinous polymers that can be employed in forming the liners 33, ABS styrene polymers are suitable, as would be polyethylene, and others that could provide a smooth, relatively tough surface facing for the slots 30'. Such polymer materials, having a thickness in the order of 0.030–0.050 inches have been found suitable for present purposes. With these liners in place, the retaining surfaces 34' of the slots are now provided by portions of the liner 33 which overlie the undercut surfaces of the slots 30'. This is to say that the liners 33 actually define the slots 30' and provide the retaining surfaces of the slots 30'. Similarly the functional, or positioning surfaces of the narrow portions of the slots 30' are also provided by portions of the liner 33 that engage the central, web portion of the joining member 32'. The foam material, however remains as the structural portion of the panel that is effective in bearing the joining pressure that exists as a result of the engaged retaining surfaces 34, 36.

The liner 33 may be initially formed as an extrusion and then cut to an appropriate length for a given panel height. The initial cross section of the liner 33 is preferably divergent from the outline of the slot 30'. This is to say that angle between the tapered slots would typically be 60 degrees. In which case the angle between the corresponding sides of the insert would be greater, say 68 degrees. Similarly, the angle between the tapered sides of the slot and the undercut surfaces could also be 60 degrees and the angle between the corresponding sides of the insert would be greater, say 64 degrees. The same principle can be applied in forming the angle between each retaining surface portion of the liner and the web engaging portion are at an angle of 46 degrees, where the corresponding angle of the slot is 90 degrees. These divergent angular relationships find utility in mounting the liner 33 in the slot 30', taking into consideration a further characteristic of the resinous polymer material of the liner, namely is resilience, also referred to as "plastic memory".

The outer, slot engaging surfaces of the liner 33 are coated with a suitable adhesive and the liner then forces into the slot 30'. The polymer material has sufficient flexibility to allow it to be flexed as it is forced through the narrow, outer end of the slot, and then, due to its plastic memory to return to its original cross section outline. The described, divergent angular relationships assure a positive contact between the engage surfaces of the line and the slot. The adhesive is chosen so that it will not set up (exhibit a bonding property)

for a length of time permitting insertion of the liner, as described. There are many suitable adhesives for this purpose, as is well known to those skilled in the art.

After the liners 33 have been mounted in the slots 30', as described, a joining member 32' is inserted into the liner defined slots 30'. The panels are held in assembled relation by positioning surfaces 36' on the joining member 32' engaging the positioning surfaces 34' of the slot 30', which are provided by portions of the liner 33.

A further feature to be noted in this embodiment is the provision of passageways 48 (FIG. 6) extending lengthwise of the tapered end portions of the joining member 32'. These passageways minimize the amount of material required in forming the retaining members and thus effect further economies in providing this joint connection for foam core panels.

FIG. 7 illustrates a blind connection of foam core panels 16" which are at right angles to each other. The panels in this embodiment comprises the same components as previously described, and have side edges mitered on a 45° angle, to that when joined they will be at right angles to each other.

While panels at this relative angle could also be joined using slots 30 that are aligned with each other and are normal to the edge faces (as in FIGS. 4 and 6), a more rigid and rugged connection can be provided by angling the slots 30" relative to the mitered edge faces, here disposed parallel to the outer surfaces of the panels 16" in which they are formed. A modified joining member 32" is inserted into the slots 30", which, again, may extend from the top rail 22 to and though the bottom rail, no shown. The interconnecting web 40" of the member 32" is angled to enter the slots 30" and may be reenforced by a thickened portion at the juncture of the angled portions. It is to be noted that, in this configuration, the inner surfaces 46 of the web 40" also provide a retaining function in maintaining the panels in joined relation. Alternatively this additional retaining function could also be provided by the inwardly facing surfaces of the enlarged, outer ends of the joining member 32"

Reference is next made to FIGS. 9 and 10 for a description of a preferred method of installing valances, utilizing the joining means of the present invention. This method is particularly adapted for supporting a valance from a ceiling grid 35, as is frequently provided in exhibition halls and the like. Such grids comprise a first set of spaced bars B1 and a second set of spaced bars B2, the latter being at right angles to the bars of the first set, and all lying in a common plane and supported in spaced relation above the exhibition floor.

After determining the desired location of the valance, the first step is to determine the desired location of the valance in relation to the supporting grid and mark the desired location on the bars B1 or B2, to which the valance will be attached. Next, one section of foam core panel 116 is attached to the grid. The panel 116, as before described, may comprise an expanded polystyrene, central core 18, a top, wooden rail 22 and a bottom wooden rail 28. Veneers 20 overlie and are bonded to the front and rear faces of the core 18 and the rails 22, 28. In this embodiment it is contemplated that the veneers 20 are simply decorative sheets of paper and, for that reason are shown without thickness. The paper veneers 20 cover over the joint between the core 18 and the rails 22, 28. As before the bottom surface of the rail 28 may also be covered by the veneer 20.

The panel attaching step may be accomplished by drilling screw holes marked locations in the previously mark positions on one or more of the bars B1 or B2. Screws 37 may then extend through the grid bar holes and engaged with the upper wooden rail 22 to secure the foam core panel section 116 to the overhead grid. In some cases the bars forming the overhead grid may be of an openwork construction, so that screws could pass therethrough. In such case the step of drilling holes in the bars may be omitted.

The foam core panel section 116 is provided with a joining member 32' which may have the same outline as the joining member 32' of FIG. 6. One vertical edge face of the panel 116 is provided with a slot 30', which extends into the panel, normally of the edge face in the same fashion as in FIG. 7. The slot 30' extends downwardly through the top rail 22 to the bottom of the core 18. The lower extent of the slot 30' preferably terminates at the bottom rail 28 for reasons discussed below. The joining member 32' is inserted downwardly into the slot 30'. The length of the joining member 32' approximates the length/height of the slot 30'. The joining member 32' is then captured in the slot 30' by a plate leveler 39 which is attached to the top of the panel 116 by screws 41, which are threaded in to the top rail 22. The plate leveler then projects in overlying relation beyond the joining member 32'. Preferably the joining member 32' and plate leveler are mounted on the panel 116 before it is secured to the overhead grid 35.

A second foam core panel 117 is then joined to the first panel 116 and secured to the grid 35 to compositely form a valance of greater width/length. The panel 117, in the usual case, will have the same height and thickness as the panel 116. Also, at the vertical end face that is to be joined to the panel 116, the panel 117 will have a slot 30', which extends through the top rail 22 of the panel 117 downwardly through its core 18 to the bottom rail 28, thus having a length/height that matches that of the slot 30' in the panel 116.

After the panel 116 is mounted in the fashion described, the panel 117 is positioned therebelow and the slot 30' of the panel 117 is aligned with the outwardly projecting portion of the joining member 32'. The panel 117 is then raised, causing the projecting portion of the joining member 32' to enter the slot 30'. The panel 117 is raised until it engages the plate leveler 39. The panel 117 may then be secured to the overhead grid 35, by further screws 37, which pass through bars B1 or B2, using predrilled holes, where necessary. The second panel is also secured to the plate leveler 39 using further screws 41 that are threaded into the upper rail 22 of the panel 117.

When the projecting portion of the joining member 32' is thus introduced into the slot 30' of the panel 117, the retaining surfaces 36 of the joining member are engaged with the retaining surface 34 of the slots 30' (as before described), thereby connecting the panel 117 to the panel 116. In this fashion it is possible to obtain an extremely close joining of the two panels, wherein there is no gap between the vertical front and rear faces of the panels. Additionally, the primary vertical, or heightwise alignment is provided by the leveler plate so that there is an smooth, surface continuity along the bottom surfaces of the two panels, without reliance on the accuracy of the horizontal alignment of the bars B1, B2.

Additional panels can be joined to the panels 116, 117 in the same fashion. It is thus possible to obtain valances of virtually any desired width/length that gives the appearance of an uninterrupted surface—a highly desired end in this type of display. The foam core panels may also be angled relative to each other in the fashion illustrated in FIGS. 6 and 7, in which case, the front and rear surfaces will be purposefully angled between adjacent panels, but they will present the appearance of a unitary structure, with an apparently uninterrupted lower surface.

Such ends are economically obtainable because the height and thickness of foam core panels can be readily controlled. This factor, combined with the described use of joining members and plate levelers makes possible the elimination of gaps and discontinuities between joined panels.

One further point to note in connection with this embodiment is that disassembly of the foam core panels is also contemplated, so that the display assembly may be reinstalled in another location—an important economic factor in many cases. Thus, for example, the screws 37 and 41 for the panel 117 can be removed so that that panel can be lowered, disengaging it from the joining member 32' and then packed for shipment or storage. It is here that engagement of the joining member 32' with the lower rail comes into play. As the panel 117 is lowered, there can be a considerable friction force exerted downwardly on the joining member 32'. If the lower end of the panel were defined by a relatively thin veneer, it is likely that the veneer would be torn, requiring its repair, before the panel 116 could be reused. Provision of the rail 28 obviates such a problem.

To this point the present invention has been described in connection with the joining of foam core panels for valances, which normally have a thickness of 1½ to 2 inches, with reference to FIGS. 4 and 7. This invention is equally applicable to the forming of other structures comprised of a plurality of foam core panels, oftentimes having a thickness of 3 inches as proportioned in FIGS. 6 and 9, or even greater thicknesses in excess of 8 inches.

Figure 11:
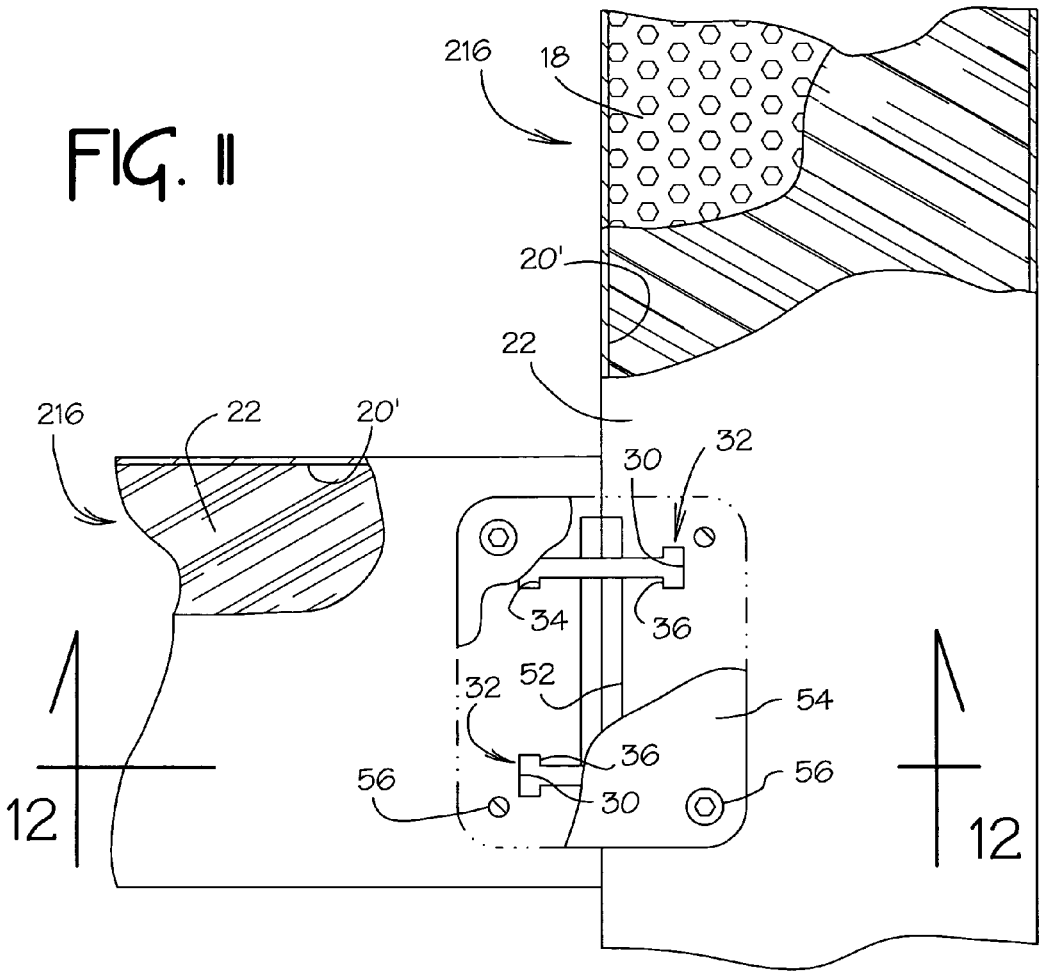
FIG. 11 is a top view, with portions broken away and in section, of pair of foam core panels joined in accordance with further teachings of the present invention.
Figure 12:
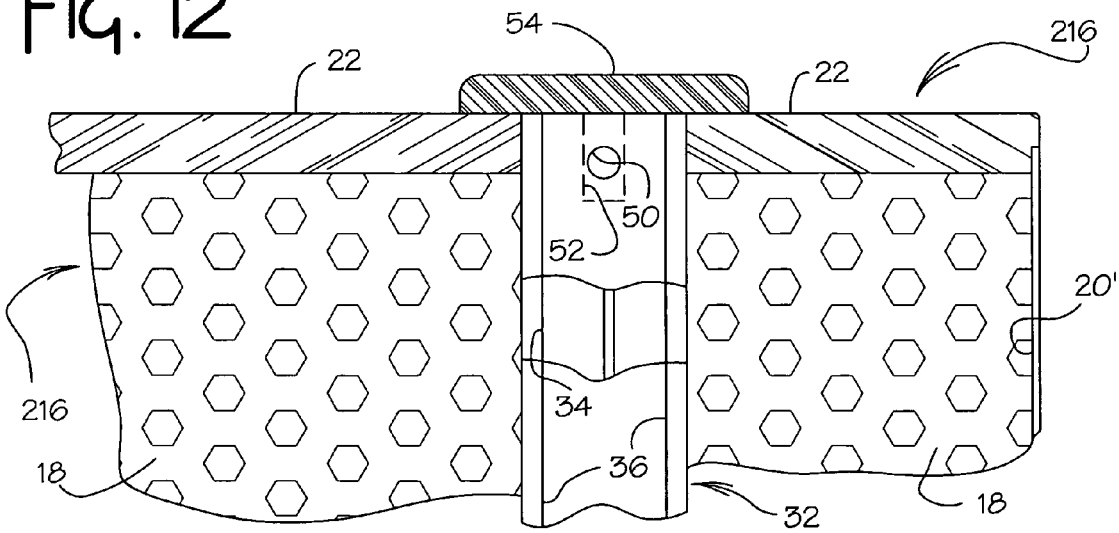
FIG. 12 is a section taken on line 12—12 in FIG. 11.

The joining of panels of greater thicknesses is further shown in FIGS. 11 and 12, where panels 216 are proportioned to illustrate a thickness of 5 inches and are illustrative of panels that are used to subdivide retail furniture display areas. The panels 216 may have a height of 3 to 5 feet and may joined in various fashions to simulate how furniture would appear when put in a customers home. FIG. 11 illustrates a "T" joint wherein one section of foam core panel 216 is butted against and joined to a second section of foam core panel 216, intermediate its length.

The panels 216 may comprise, as before, a central core 18 of expanded polystyrene and an overlying top rail 22, bonded thereto. This embodiment also illustrates that the veneers 20' may be extremely thin and provided purely for decorative purposes. It will be seen that the side edges of the rails are rabbeted so that the upper portions of the panels 216 are defined solely by the rails 22 and the outer surface of the veneer. Each of the panels 216 may also comprise a wood bottom rail, as before described.

The connecting means in this assembly may comprises a pair of joining members 32, which are inserted into T-shaped slots 30, formed respectively in the vertical side edge face of one of the panels 216 and vertically of the front face of the other of the panels 216. The connecting function is as before described, with retaining surfaces 34 of the slots 30 being engaged by retaining surfaces 36 on the members 32. In this embodiment provision is also made for ready repositioning of the panel components that make up furniture display area. Thus, a hole 50 is provided at the upper end of each joining member 32. Portions of the top rails 22 are recessed at 52 to provide access to the holes 50. It is thus possible to engage the holes 50 with a hook (not shown) and thereby enable manual removal of these joining members. The panel components can then be reassembled in combination with other panel components to give a new look to the furniture display area.

A plate 54 may be secured to the top rails 22, as by screws 56 to thereby prevent ready access to the joining members 32 and guard against unauthorized removal of the joining members. Enhanced security means could be provided where needed to further inhibit access to the joining members 32.

It will be appreciated that the use of a pair of joining members, as opposed to the use of a larger, single joining member, yields the advantage of providing a stronger connection between the joined panels and at the same time minimizes the extent to which the joining means extend lengthwise of the joined panels, or cross-wise in the case of a "T" joint.

The use of liners to protect surfaces of the slots, in the foam cores, from abrasion (as described in connection with FIG. 6, could also be advantageously employed in the embodiment of FIGS. 11 and 12, where it is contemplated that the panels are to be frequently reconnected in changing the appearance of a display room.

There are other applications for foam core panels where their height can be as much as eight feet, or even more. Again this application can find its setting in an exhibition hall where it is desired to create simulated work spaces providing some measure of privacy.

The challenge to assembling foam core panels having heights of this extent is in providing a joining member that extends from top to bottom of joined panels. Assuming an eight foot high panel, that means that the joining member, as previously described would also be in the order of eight feet. This means that for the joining member to be inserted to join two panels, it is necessary for there being at least 16 feet of overhead clearance, if other than a straight wall is being formed by the assembled panels. Notwithstanding the light weight of the foam core panels, it is awkward at best to manipulate the panels and a single joining member in attaching one panel to another, and, in many cases, it becomes impossible to do so because there is insufficient overhead clearance.

Reference is next made to FIGS. 13–18 for a description of the fashion in which these difficulties in joining foam core panels of substantial height may be overcome.

Figure 13:
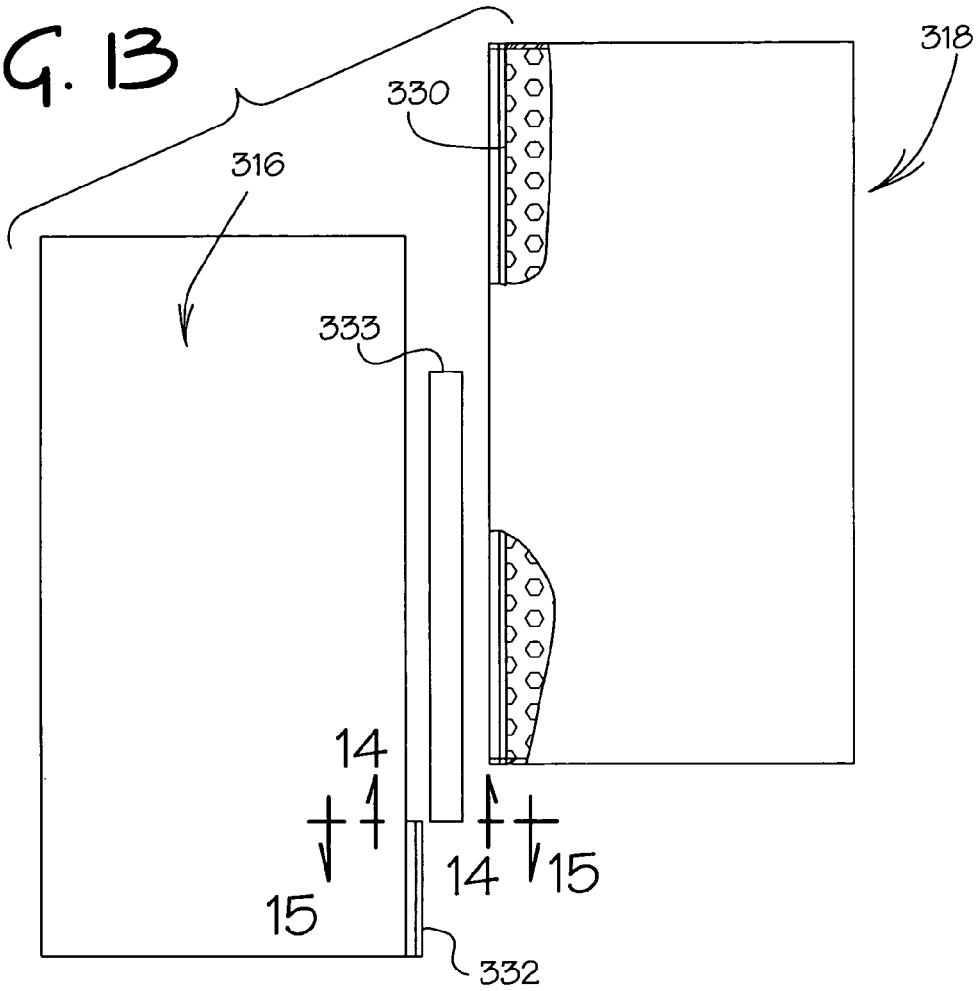
FIG. 13 illustrates a method of assembling foam core panels in the forming of relatively high, wall defining structures.
Figure 14:
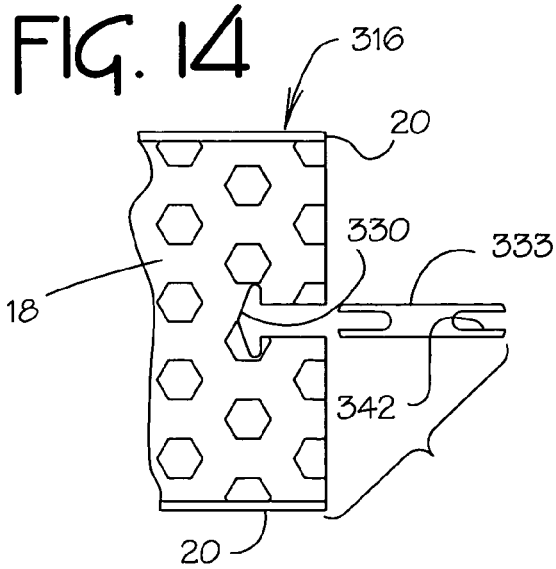
FIG. 14 is a section, on an enlarged scale, taken on line 14—14 in FIG. 13 and looking in the direction of the arrows.

FIG. 13 illustrates a pair of foam core panels 316, 318, which may be fabricated in the same fashion previously described, comprising an expanded polystyrene foam core 18, and veneers 20 on their front and rear faces. The panels 316 and 318 typically would have a height of eight feet and a width of four feet and a thickness between three and eight inches. The panels 316, 318 may also include top and bottom rails, as shown in the prior embodiments.

The side edge faces of the two panels that are to engage each other, are each provided with a vertically extending slot 330, which has an enlarged inner end portion that defines undercut retaining surfaces 34.

Figure 15:
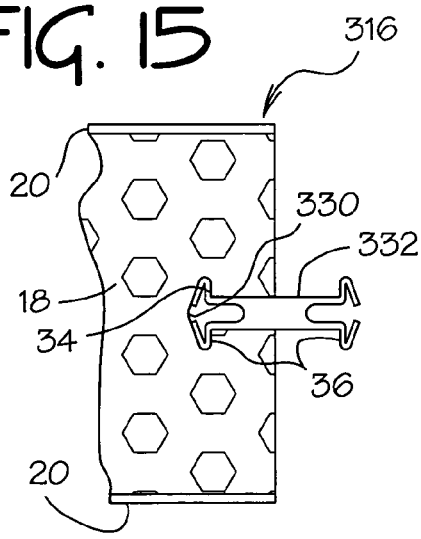
FIG. 15 is a section, on an enlarged scale, taken on line 15—15 in FIG. 13 and looking in the direction of the arrows.
Figure 16:
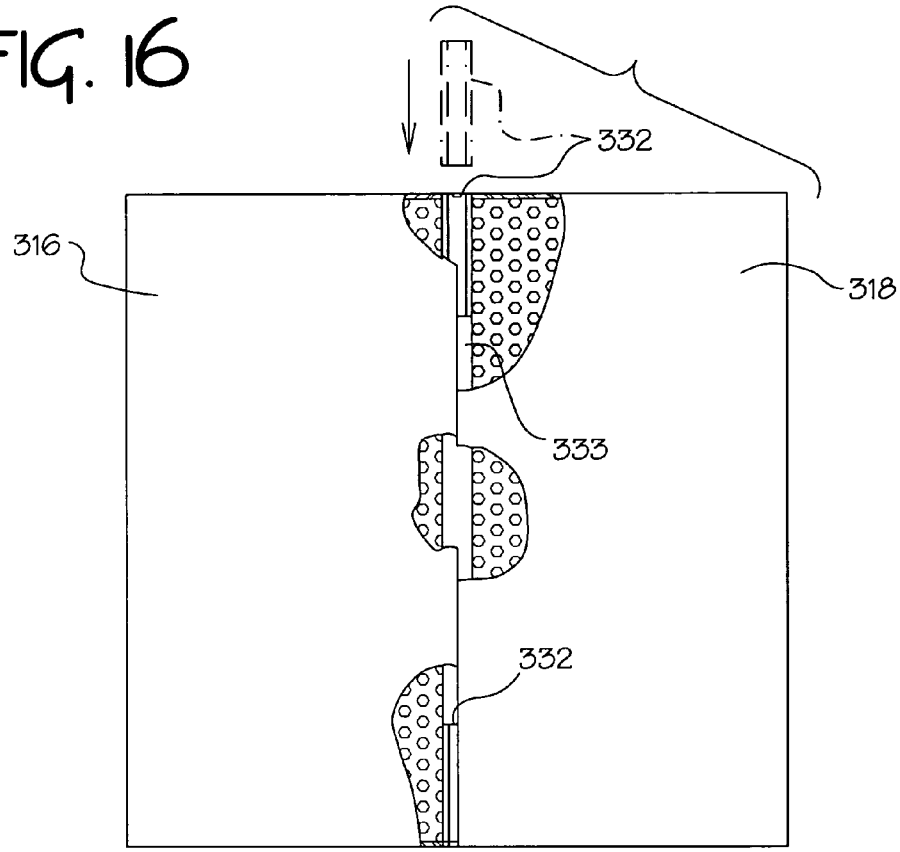
FIG. 16 illustrates the completed assembly of the core panels of FIG. 13.

The first step in joining the two panels is to insert a relatively short joining member 332 in the lower end of the slot 330 of one of the panels, as illustrated in FIGS. 13 and 15. The joining member 332 is provided with retaining surfaces 36 which are engageable with the undercut retaining surfaces 34 of the slot 330. The next step is to insert and alignment member 333 into the slot 330, positioning it immediately above the joining member 332. The next step is to bring the side edge face of the panel 318 into engagement with the matching side edge face of the panel 316, with the lower end of the panel 318 above the joining member 332, as the alignment strip 333 is inserted into the slot 330 of the panel 318. Once the side edge faces of the two panels are engaged, the panel 318 may be lowered to engage the joining member 332 in the lower end of the slot 330 in that panel. Retaining surfaces 336, at the opposite side of the retaining member 332 engage undercut retaining surfaces on the panel 318 to thus hold the lower ends of the panels 316, 318 in assembled relation in the same fashion as previously described. The final step, illustrated in FIG. 16, is to insert a second joining member 332 into the upper ends of the slots 330 of the two panels 316, 318.

The upper and lower ends of the two panels are thus joined with their side edge faces held in abutting relationship by the retaining surfaces 36 of the joining members 332 being in engagement with the undercut retaining surfaces 34 of the slots 330. As before, the central, or web portion of the retaining members 332 have a thickness closely approximating the width of the outer end of the slots 330 so that they serve to maintain the front and rear surfaces of the panels in alignment. The alignment strip 333 then has a thickness which also closely approximates the width of the outer end portions of the slots 330. The central portions of the front and rear faces of the panels 316, 318, intermediate the upper and lower joining members 332, are thus maintained in alignment.

Figure 17:
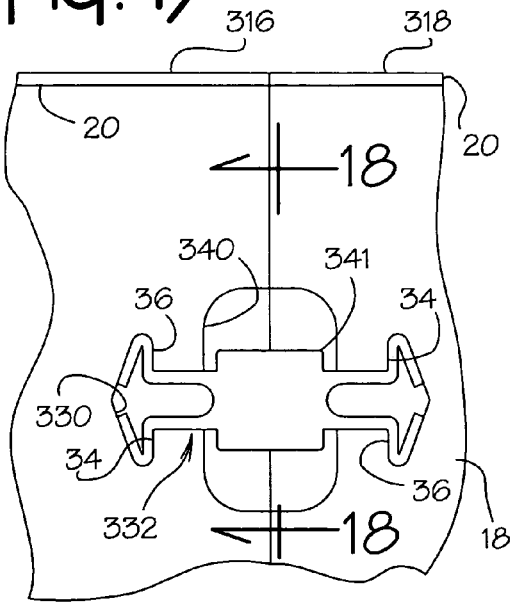
FIG. 17 is a top view, on an enlarged scale, of the assembled panels seen in FIG. 16.
Figure 18:
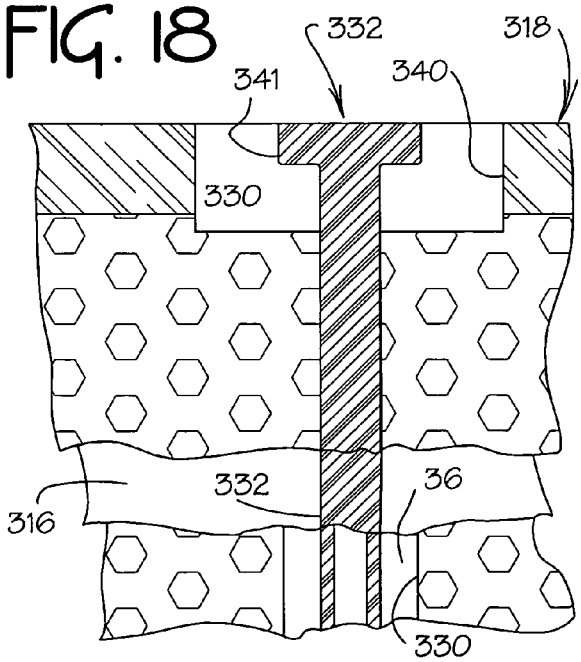
FIG. 18 is a view taken on line 18—18 in FIG. 17.

As before, the assembled panels can readily be disconnected so that they may moved and set up in another location. To facilitate this end, the upper ends of the panels, adjacent the slots 330 may be recessed at 340 and finger grips 341 provided at the upper ends of the upper joining member 332 (FIGS. 17, 18). This configuration enables the upper end of the upper joining member to be manually gripped and withdrawn from the slots 330. Once this is done, it is a simple matter to raise one of the panels above the lower joining member 332 and then to laterally separate the two panels. It will also be appreciated a rod or the like can be engaged with the upper end of the alignment strip 333, so that the one panel can be raised upwardly above the lower joining member 332, to thereby enable lateral separation of the panels. The height/length of the joining members determines the minimum overhead clearance that is required in joining panels of a given height.

Figure 8:
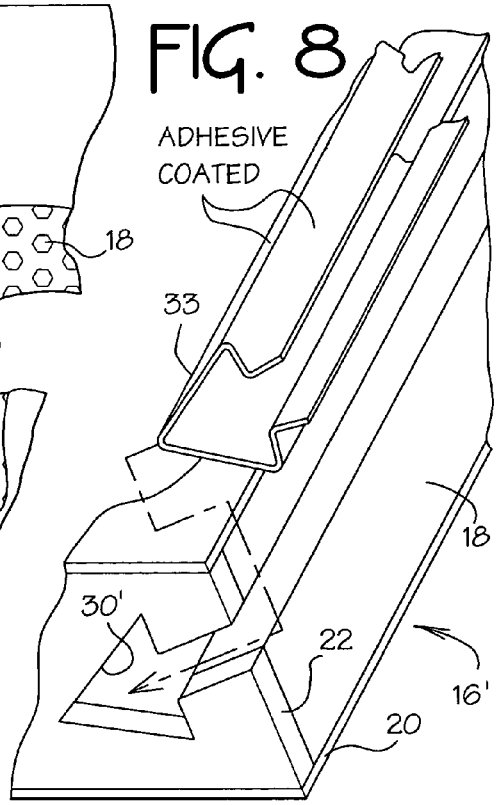
FIG. 8 is a perspective view illustrating the assembly of a liner component employed in the embodiment of FIG. 6.

The length/height of the joining members 332 is therefore preferably set at a minimum consistent with providing proper contact between the connected panels, and also consistent with an acceptable wear life where the panels are to be repeatedly set up and then disassembled. Generally speaking an acceptable length/height ranges between six and eighteen inches. Wear life of the panels can also be extended through the provision of a solid plastic liners for the functional surfaces of the slots 330, as described in connection with FIG. 8.

Another feature to be noted from this embodiment is the alternate approach to minimizing the quantity of plastic employed in forming the joining members 332 and alignment strips 333, and, of course, their costs.

Thus, the outer ends of both are formed by thin walled portions. In the case of the alignment strip, the outer end portions, indicated at 342, have no load bearing function. They simply provide means for generally positioning the solid, central portion of the alignment strip, in the narrow, outer portions of the slots 330, where they provide a positioning function.

Similarly the outer, lateral end portions of the joining members 332 extend from a solid central portion which provides the function of aligning the front and rear surfaces of the panels. These bifurcated outer end portions are angled outwardly to define the retaining surfaces 36. The outmost end portions of the bifurcated sides of the joining members 332 then extend inwardly toward the center line of the joining member. The joining members 332 thus provide their connecting and aligning functions, while at the same time the amount of material required and the their costs are minimized.

The described invention is uniquely adapted to existing practices and technologies for achieving economies in the fabrication of structures formed by a plurality of foam core panels. This is to point out that the existing practices for the fabrication of foam core panels need no change and in fact involve simplification in that wooden side rails or other additional components required for conventional blind joining means are no longer required. Foam core panels can be assembled in a given height and an extended length, in a horizontal direction. Such panel stock can then be cut to any desired length/width. Panels of a desired length require only the provision of slots along its side edges. The slots may be readily formed using conventional woodworking router bits. It is also to be appreciated that the length of a panel can be readily changed on site, when unexpected problems require the shortening of panel. A panel can be cut to a new length through the use of a conventional circular saw. Then a new slot for the joining member can be cut using a portable router.

Figure 19:
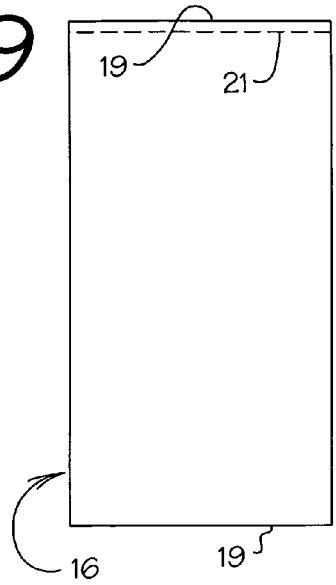
FIG. 19 is a plan view of a foam core panel that is to be custom fitted during installation on a job site.

The manner of custom fitting a foam core panel is further illustrated in FIGS. 19–22. A typical foam core panel 16 is seen in FIG. 19. This panel may be of the same basic construction described in connection with panel 16 of FIGS. 4 and 5, comprising a foam core (18), top (22) rails and bottom rails (not shows in FIGS. 19–22) and veneers (20) on its opposite faces. The edge faces 19, at opposite ends of the panel define the length/width of the panel. It is contemplated that the panel 16 has been initially formed at a panel manufacturing facility, with undercut retaining slots formed in the edge faces 19 in accordance with the preceding teachings.

When, during installation of the panel 16 in the field, it is discovered that its width is too great, it is a simple matter to shorten the length of the panel and reduce its width, while at the same time preserve the ability to employ the joining means of the present invention. Thus the first step is to determine the degree to which the panel exceeds the desired length. The panel is then marked, as indicated by line 21 in FIG. 19, to indicate the desired length of the panel.

Figure 20:
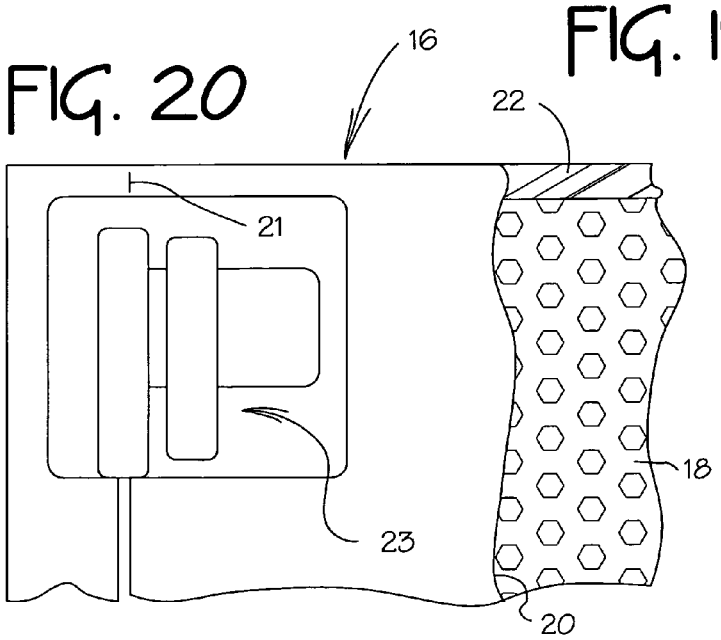
FIG. 20 illustrates one step in the custom fitting of the panel seen in FIG. 19.

The next step is then to remove the excess length of the panel. This step is illustrated in FIG. 20 where removal is accomplished through use of a portable, electrically powered, circular saw 23, which permits customizing the panel on the installation, job site. As shown, a saw cut along line 21 is almost completed. When completed, the panel 16 will have the necessary length for the intended installation.

Figure 21:
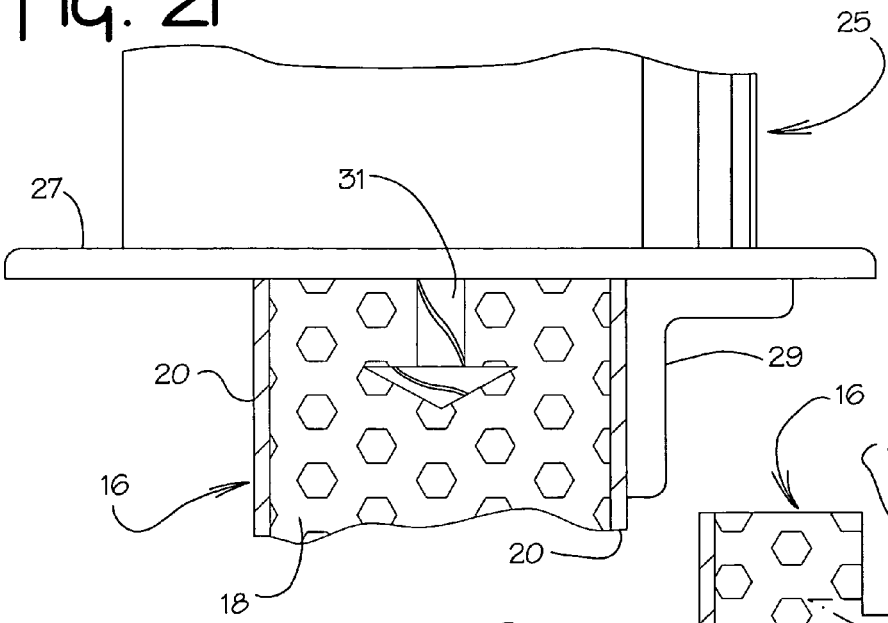
FIG. 21 illustrates another step in the custom fitting of the panel seen in FIG. 19.

After the panel has been thus shorted to a desired length, an undercut slot is formed along length of the edge face 19. Consistent with customizing the panel on the installation job site, a portable, electrically powered router may be employed to obtain this end. This step is illustrated in FIG. 21. A portable power router 25 is positioned with its base plate 27 resting on the newly cut end face of the panel 16. The base plate may be provided with a fence 29 which engages one of the veneered faces of the panel 16 and centers the axis of the router relative to the end face 19. The router is provided with a cutting bit which has an outline that matches the desired outline of the undercut slot. The router may be readily moved along the length of the face 19 to cut an undercut retaining slot, here illustrated as having an outline generally corresponding to that of the embodiment of FIG. 14.

Figure 22:
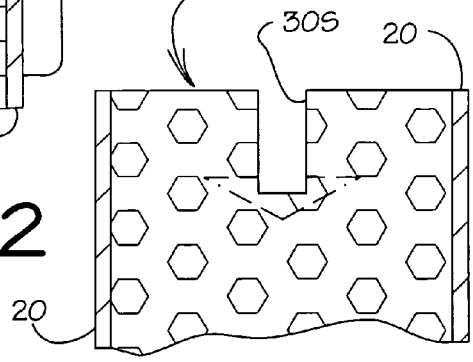
FIG. 22 illustrates and alternate step in the custom fitting of the panel seen in FIG. 19.

FIG. 22 illustrates an alternate method by which the undercut slot may be formed. Instead of employing a single router bit which has the outline of the undercut slot, the slot is formed by making two passes of with the router. The first pass may be made with a straight router bit to form the outer portion of the joining member slot, as indicated at 30S in FIG. 22. A second pass is then made with the router, using a second bit, which forms the undercut portion of the slot, as indicated by the broken lines in FIG. 22.

Not only can the undercut slots be economically formed either in the initial manufacture of panels, or in their being custom fitted for a given installation, but the joining members are also inexpensive to provide. Conventional extrusion equipment can be employed in forming the joining members. Further savings can be achieved, particularly on retaining members have a relatively large cross section, by making portions of the members hollow, as previously pointed out in connection with FIG. 6, or thin walled as described in connection with FIGS. 17 and 18.

It is to be understood that where the foam core panels are comprised in assemblies that are isolated from the likelihood of being subjected to forces that might distort the panels, or might stress the joining member connection therebetween, then both the top rails and the bottom rails of the foam core panels may be eliminated.

Also, under such conditions and particularly where it is desired to minimize the weight of a foam core panel assembly, the veneer 20 can be of paper or other thin, light weight material (as in the last-described embodiment), which serves primarily a decorative function, as opposed to a structural function which can be provided by veneers formed from hard board or wood laminates.

Those skilled in the art will also recognize that features shown in only one embodiment herein, can also find utility in other embodiments herein disclosed as well as in other variations of those embodiments. The scope of the present inventive concepts is therefore to be founded solely on the following claims.

Having thus described the invention, what is claimed as novel and desired to be secured by Letters Patent of the United States is:

1. An assembly of foam core panels comprising a pair of panels in joined relation wherein each panel comprises a foam slab of foamed plastic material having opposed lateral surfaces spaced apart by the thickness of the slab, the lateral surface area of the panel being defined at least in part by the lateral surface area of the slab, and veneers, respectively bonded to the lateral surfaces of the slab, and each panel has an abutting surface formed and defined by a portion of the its foam slab, and means for joining said panels with said abutting surfaces held in engaged relation, characterized in that the joining means comprise slots formed, respectively, in said foam slabs, said slots extending inwardly from said abutting surfaces, each slot being undercut to form retaining surfaces facing away from the abutting surface in which it is formed, and a joining member inserted into said slots, said joining member having retaining surfaces respectively engaging the retaining surfaces of said slots, thereby maintaining the panels in joined relation with said abutting surfaces maintained in abutting and engaged relation.

2. An assembly of foam core panels as in claim 1 wherein each abutting surface comprises a side edge face of the panel defined by said slab and the veneers secured thereto.

3. An assembly of foam core panels as in claim 2, wherein said panels have a rectangular configuration and are vertically disposed with the abutting side edge surfaces also vertically disposed, and further wherein each of said panels further comprises a top rail overlying said slab and coextensive with the top surface thereof and a bottom rail underlying said slab and coextensive with the bottom surface thereof, and the joining means further comprise undercut slots formed in said top and bottom rails as continuations of the undercut slots in said foam slab, and the joining member extends into the undercut slots formed in said top and bottom rails, whereby the forces imposed on the foam slabs in maintaining the panels in joined relation are minimized.

4. An assembly of foam core panels as in claim 3 further characterized in that the outer veneers disposed on opposite lateral surfaces of the core are also coextensive with the side faces of the top and bottom rails and further wherein the top rails of the joined panels form a first set of rails and the bottom rails of the joined panels form a second set of rails, and further wherein the ends of the undercut slots in one set of rails extend from the slab to a horizontal surface of said one set of rails, and further wherein a veneer is secured to each of said horizontal surfaces of said one set of rails, thereby concealing the ends of the slots in said one set of rails from view.

5. An assembly of foam core panels as in claim 4 wherein means are provided in at least one of said top rails for connecting the panels to an overhead support; and said one set of rails are bottom rails.

6. An assembly of foam core panels as in claim 1 further characterized in that the slots extending inwardly from the abutting surfaces of the panels, extend inwardly at right angles thereto, and the bottoms of the slots are undercut to form said slot retaining surfaces.

7. An assembly of foam core panels as in claim 6 wherein the joining member has a relatively narrow, central web which is snugly received by the portions of the T-shaped slots adjacent the abutting surfaces, and thickened outer ends at its opposite ends, on which the retaining surfaces of the joining member are formed.

8. An assembly of foam core panels as in claim 2 wherein said panels have a rectangular configuration and are vertically disposed, and further wherein the panels are angularly disposed, one relative to the other, the abutting surfaces are mitered to compositely define the angled relation between the panels, and the portions of the slots adjacent the abutting surfaces are aligned and the joining member has a central web which is snugly received by the portions of the slots which are adjacent the abutting surfaces.

9. An assembly of foam core panels as in claim 8 wherein
the outer end portions of the slots are aligned and
the bottom portions of the slots are tapered toward each other from the widest portions of the retaining surfaces, thereby minimizing the material removed in forming said slots.

10. An assembly of foam core panels as in claim 2 wherein
said panels have a rectangular configuration and are vertically disposed, and further wherein
the panels are angular disposed one relative to the other,
the abutting surfaces are mitered to compositely define the angled relation between the panels, and
the portions of the slots adjacent to the abutting surfaces are angularly disposed to each other and the
the joining member has a central web which is angled to be received by outer portions of the slots.

11. An assembly of foam core panels as in claim 1 wherein
an angled camming surface is provided on the joining member at one end thereof, said camming surface being adapted to draw said panels toward each other when the joining member is slid lengthwise into said slots, as the panels are being joined.

12. An assembly of foam core panels as in claim 1 wherein
the volume of material in the joining member is minimized by passageway means extending longitudinally thereof.

13. An assembly of foam care panels as in claim 1 wherein the volume of material in the joining member is minimized by the retaining surfaces thereof being defined by longitudinally extending, thin walled portions.

14. An assembly of foam core panels as in claim 13 wherein
the joining member comprises
a longitudinally extending, relatively thin, solid, central section and longitudinally extending, thin walled portions at the opposite sides of the central section,
the thin wall sections extend outwardly from the planes of the opposite sides of the central section, to define the said retaining surfaces and then are angled, on opposite sides of the central section away from the central section and toward each other.

15. An assembly of foam core panels as in claim 1 wherein
the panels are angularly disposed one to the other,
one of said abutting surfaces comprises a side edge face of one of said panels as defined by the slab thereof and the veneers secured thereto;
the other abutting surface is comprises a portion of the lateral surface the other panel.

16. An assembly of foam core panels as in claim 1, wherein
said slots comprise a first set of slots and
the means for joining the panels further comprise
a second set of slots formed, respectively, in said foam slabs generally parallel to the first set of slots,
said second set of slots comprising second slots extending inwardly from said abutting surfaces thereof,
each second slot being undercut to form retaining surfaces facing away from the abutting surface in which it is formed, and
a second joining member inserted into said second slots,
said second joining member having retaining surfaces respectively engaging the retaining surfaces of said second slots.

17. An assembly of foam core panels as in claim 16, wherein
the second joining member has the same cross section as the first mentioned joining member.

18. An assembly of foam core panels as in claim 1, wherein
the retaining surfaces of the slots are defined by a solid resinous polymer material.

19. An assembly of foam core panels as in claim 1, which forms a valance, said assembly further comprising
means for mounting each of said pair of panels from overhead support means and
a leveler plate secured to the top surfaces of the joined panels and providing the primary means for vertically aligning the panels thereby providing an accurate vertical alignment, therebetween, irrespective of any vertical misalignment in the means for mounting said panels from the overhead support means.

20. An assembly of foam core panels as in claim 19, wherein
each panel comprises a top rail which
is engaged by the means for mounting the panels from the overhead support means, and
to which the leveler plate is secured.

21. An assembly of foam core panels as in claim 20 wherein
at least one of said panels has a bottom rail,
the slot in said one panel extends through the top rail, downwardly through the foam core and terminates at the top of the bottom rail,
whereby, when the assembly is dismantled, the one panel may remain mounted, and the other panel may be lowered to disengage it from said one panel, and the bottom rail resists the downward force on the joining member during such removal.

22. An assembly of foam core panels as in claim 1, wherein
said panels have a rectangular configuration and are vertically disposed, and further wherein
the panels have a substantial height,
the joining member is disposed in the lower end portions of said slots, and further comprising
an alignment strip disposed in said slots above said joining member, said alignment strip having a thickness approximating the width of the slots adjacent the abutting surfaces to thereby maintain the panels in aligned relation, and
a second joining member disposed in the upper end portions of said slots, said second joining member having retaining surfaces respectively engaging the retaining surfaces of at the upper end portions of said slots, thereby maintaining the upper end portions of the panels in joined relation.

23. An assembly of foam core panels as in claim 22, wherein
the upper surfaces of the panels are recessed and
the upper end portion of the upper joining member is dispose in said recess, and
the upper end portion of the upper joining member has a finger grip for facilitating its removal in disassembling said joined panels.

24. An assembly of foam core panels as in claim 22, wherein
each of said panels further comprises a top rail and a bottom rail for providing structural integrity to the panels.

25. A method of forming an assembly of foam core panels comprising a pair of panels in joined relation wherein each panel comprises a foam slab of foamed plastic material having opposed lateral surfaces spaced apart by the thickness of the slab, the lateral surface area of the panel being defined at least in part by the lateral surface area of the slab, and veneers, respectively bonded to the lateral surfaces of the slab and;

each panel has an abutting surface formed and defined by a portion of its foam slab, characterized in that the slab of each panel has a slot formed therein and extending inwardly from the abutting surface thereof, each slot being undercut to form retaining surfaces facing away from the abutting surface in which it is formed, said method comprising the steps of bringing the two panels into an assembled relation with said abutting surfaces in abutting and engaged relation and connecting the two panels in this assembled relation by longitudinally introducing a joining member into said slots so as to bring retaining surfaces on said joining member into engagement with the undercut, retaining surfaces on the respective panels.

26. A method of forming an assembly of foam core panels as in claim 25 wherein the panels are vertically disposed;

the abutting surface of each panel is a side edge surface of that panel defined by the thickness of the slab and by the side edges of the veneers that are bonded to that slab; and the abutting surfaces and the slots therein are vertically disposed, and comprising the further steps of first mounting one of said panels on an overhead support, disposing the joining member in the undercut slot of said one panel, with a portion the joining member projecting outwardly from the vertical side edge surface thereof, securing a leveler plate on the top of said one panel to thereby capture said joining member in the slot thereof, said leveler plate being mounted so as to project beyond the vertical side edge surface of said one panel, positioning the other panel below the mounted panel with its abutting surface aligned with the abutting surface of the mounted panel, displacing said other panel upwardly into engagement with the leveler plate to capture the outwardly projecting portion of the joining member in the vertical slot of said other panel, thereby bringing the two panels into an assembled relation and introducing the joining member into said slots, and the further steps of securing the other panel to the overhead support, and securing the other panel to the leveler plate.

27. A method of forming an assembly of foam core panels as in claim 25 wherein the panels are vertically disposed;

the abutting surface of each panel is a side edge surface of that panel defined by the thickness of the slab and by the side edges of the veneers that are bonded to that slab;

said slots extend vertically along the height of the panels, and at least the lower and upper end portions of the bottoms of said slots are undercut to define retaining surfaces, and comprising the further steps of inserting a joining member into the lower end portion of the slot in one of said panels, said joining member projecting outwardly from the vertical abutting surface of said one panel, inserting an alignment strip into the slot in said one panel, said alignment strip being disposed above said joining member and having a portion of uniform thickness projecting beyond the edge surface of said one panel, positioning the other of said panels with its abutting surface in opposed, spaced relationship from the abutting surface of said one panel, and with the lower end of the other panel above the upper end of the joining member projecting from the one panel, displacing the other panel toward the one panel, to bring their vertical abutting surfaces into engagement and simultaneously introduce the alignment strip into the vertical slot of the other panel, after the abutting surfaces are engaged, displacing the other panel downwardly to capture the joining member in the lower end portion of the vertical slot in the other panel, and inserting a second joining member in the upper end portions of the slots of the two panels, said second joining member having opposed retaining surfaces which are thereby engaged with the undercut portions of the slots.

28. A method of forming an assembly of foam core panels as in claim 25 wherein it is necessary that a portion of a panel be removed to provide a desired panel length, comprising the further steps, performed prior to joining the panels, of marking one of the foam core panels to indicate the portion of the panel that must be removed to provide a desired panel length for a given installation, removing the portion of the panel required to provide a desired panel length, and in so doing providing a freshly cut abutting surface on the panel, and forming an undercut slot longitudinally of said freshly cut abutting surface.

29. A method of forming an assembly of foam core panels as in claim 25 where it is desired to provide wear resistant surfaces for said undercut slots, said method including the further steps of providing a liner of plastic polymer material having plastic memory, said liner being formed with an outline that corresponds to the outline of the slot, but is angularly divergent relative thereto, coating the outer surface portions of the liner with an adhesive, forcing said liner through the opening of said slot to the bottom thereof in a fashion that enables the plastic memory of the polymer material to bring the adhesive coated surfaces of the liner into engagement with the surfaces of the slot, whereby a solid resinous polymer, wear resistant retaining surface is provided for the slot.

30. A method of joining foam core panels as in claim 26 wherein said panels each comprise a top rail, and the step of securing the one panel to the overhead support comprises threading at least one screw through the overhead support and into the top rail of the one panel, the step of securing the other panel to the overhead support comprises threading at least one screw through the overhead support and into the top rail of the other panel, and the steps of securing the leveler plate to the one panel and to the other panel comprise threading screws into the top rail of said one panel and into the top rail of said other panel, respectively.

31. The method of joining foam core panels as in claim 26 wherein the step of securing the leveler plate to the one panel is performed after the step of inserting the joining member into the slot of the one panel and before the step of mounting the one panel on the overhead support.

32. A method of joining foam core panels as in claim 26 wherein said one panel further comprises a bottom rail and the slot in said panel extends from the top of the panel and terminates at the bottom rail, and comprising the further step of disassembling the panels so joined, by means of the following steps, unsecuring said other panel from the overhead support, unsecuring said other panel from the leveler plate, and displacing said other panel downwardly to withdraw the joining member from the slot in said other panel, as downward frictional forces on the joining member are resisted by the bottom rail of the one panel.

33. A method of customizing foam core panels as in claim 28, wherein the removing step is performed through the use of a portable, electrically powered saw, and the step of forming a slot is performed through the use of a portable, electrically powered router, whereby the customizing can be done on the installation job site.

34. A method of customizing foam core panels as in claim 28, wherein the step of forming said longitudinal slot comprises forming the outer portion of said slot by employing a first pass with a straight router bit, and forming undercut portions of said slot by employing a second pass with a router bit.

* * * * *